US011135737B2

(12) United States Patent
Ascone

(10) Patent No.: US 11,135,737 B2
(45) Date of Patent: Oct. 5, 2021

(54) EQUIPMENT FOR CUTTING POLYSTYRENE BLOCKS IN AN AUTOMATED WAY

(71) Applicant: Nettuno Sistemi di Ascone Salvatore & C. S.a.s., San Ferdinando (IT)

(72) Inventor: Salvatore Ascone, Rosarno (IT)

( * ) Notice: Subject to any disclaimer, the term of this patent is extended or adjusted under 35 U.S.C. 154(b) by 117 days.

(21) Appl. No.: 16/470,592

(22) PCT Filed: Dec. 27, 2016

(86) PCT No.: PCT/IT2016/000308

§ 371 (c)(1),
(2) Date: Jun. 18, 2019

(87) PCT Pub. No.: WO2018/122881

PCT Pub. Date: Jul. 5, 2018

(65) Prior Publication Data

US 2019/0366576 A1 Dec. 5, 2019

(51) Int. Cl.

| | |
|---|---|
| ***B26F 3/12*** | (2006.01) |
| ***B26D 3/00*** | (2006.01) |
| ***B26D 5/20*** | (2006.01) |

(52) U.S. Cl.

CPC ..... *B26F 3/12* (2013.01); *B26D 5/20* (2013.01); *B26D 3/006* (2013.01)

(58) Field of Classification Search

CPC ..... B26F 3/12; Y10T 83/293; Y10T 83/9292; B26D 3/006; B26D 7/10; B26D 5/20; B23D 57/0061; B23D 57/0069; B23D 57/0053; B23D 57/0007

USPC ..... 83/171, 651.1, 307.1–307.3, 83/522.11–522.29, 849–868

See application file for complete search history.

(56) References Cited

U.S. PATENT DOCUMENTS

| | | | | |
|---|---|---|---|---|
| 2,972,669 A * | 2/1961 | Brown | B26D 3/006 | 83/171 |
| 3,635,207 A * | 1/1972 | Grage | B28D 1/08 | 125/21 |
| 4,067,312 A * | 1/1978 | Tessner | B23D 57/0061 | 125/21 |
| 4,536,145 A * | 8/1985 | Sawyer | B26F 3/12 | 425/289 |
| 4,601,224 A * | 7/1986 | Clark, III | B26F 3/12 | 700/160 |
| 4,699,032 A * | 10/1987 | Clark, III | B26F 3/12 | 83/171 |

(Continued)

FOREIGN PATENT DOCUMENTS

| | | | |
|---|---|---|---|
| DE | 3237907 | 5/1984 | |
| DE | 9100987 | 4/1991 | |
| WO | WO-9814311 A1 * | 4/1998 | B26F 3/12 |

*Primary Examiner* — Laura M Lee

(74) *Attorney, Agent, or Firm* — Themis Law

(57) ABSTRACT

An assembly for cutting a polystyrene block includes a lever element, adapted to be coupled to a hot cutting element, and a control device connected thereto. The lever is arranged so that a potential inclination of the hot cutting element can be followed during the feed motion of the cut, the lever further cooperating with a sensor set to detect a potential inclination deviation of the lever during the cut, in relation to an initial reference inclination, the control device being set to vary feed motion speed depending on the detected variation of inclination.

20 Claims, 8 Drawing Sheets

(56) References Cited

U.S. PATENT DOCUMENTS

| | | | | |
|---|---|---|---|---|
| 5,429,163 | A * | 7/1995 | Frenkel | B26D 7/10 144/2.1 |
| 5,826,873 | A * | 10/1998 | Lavermicocca | A63F 9/12 273/157 R |
| 7,503,831 | B2 * | 3/2009 | Radkevich | B23D 57/0061 125/16.02 |
| 8,205,534 | B2 * | 6/2012 | Yazawa | B23D 57/0038 83/651.1 |
| 8,695,472 | B2 * | 4/2014 | Matteucci | B28D 1/088 83/794 |
| 2007/0252425 | A1 * | 11/2007 | Radkevich | B23D 57/0069 299/35 |
| 2007/0267006 | A1 * | 11/2007 | Ogyu | B28D 1/08 125/21 |
| 2009/0320658 | A1 * | 12/2009 | Yazawa | B23D 57/0038 83/13 |
| 2010/0006082 | A1 * | 1/2010 | Glinski | B28D 5/045 125/16.02 |
| 2011/0314984 | A1 * | 12/2011 | Stege | G05B 19/19 83/171 |
| 2015/0266117 | A1 * | 9/2015 | Koma | B23D 57/0069 83/13 |
| 2018/0085969 | A1 * | 3/2018 | Takahashi | B23D 59/001 |
| 2020/0047266 | A1 * | 2/2020 | Douche | B23D 57/0061 |

* cited by examiner

EQUIPMENT FOR CUTTING POLYSTYRENE BLOCKS IN AN AUTOMATED WAY

TECHNICAL FIELD

The present invention refers to the technical field of equipment for cutting polystyrene.

In particular, the invention refers to equipment configured to make cuts, according to preset geometries, that prove to be particularly precise, thus minimizing errors and waste.

BACKGROUND ART

Machineries for cutting polystyrene blocks to obtain specific forms have been known for a long time.

Polystyrene cutting, starting generally from initial blocks, allows obtaining products with various geometries, used in many fields, for example interior design, art and buildings.

Polystyrene cutting is generally made by a metal wire, which is heated to predetermined temperature through the passage of electric current, thus taking advantage of a resistive effect, named Joule effect.

Each wire is linked at its ends to two sliders that are mobile towards one or more directions, for example along a horizontal and vertical axis or following curved or diagonal paths.

Therefore, the sliders move driven by a controlling device (generally a programmable PC or a PLC) according to a determined path. The controlling device, through a suitable program, allows inserting the initial references, cutting geometries and measures, and, therefore, activates and controls the engines so as to obtain the programmed cut. Therefore, the initial block is cut into predetermined desired shapes.

Many types of machineries exist, each one of which is specific for particular cuts, also by using more wires in a parallel arrangement.

In this way, by more working cycles if required, it is possible to shape the block, also according to particularly complex geometries.

After this introduction, a remarkable technical inconvenience occurs in the prior art, which frequently affects the quality of the end product negatively, even with the risk of product waste.

The wire temperature and the advancement speed thereof are two variables to be necessarily coordinated, for optimizing the end product quality.

In fact, a non-optimal temperature, for example a little lower than required, would need a slower feed advancement, for allowing a correct cut by the wire. If it does not take place, a progressive bending of the wire may cause an inaccurate cut, as the feed advancement is too fast in respect to the melting speed of the material. On the contrary, a too warm wire with a too slow feed advancement causes an excessive local melting of polystyrene with an irregular cut, leading to product waste.

Therefore, the ideal cutting temperature and feed advancement speed are parameters connected with each other and, in turn, they are conditioned by additional typical features of the piece to be cut and the environmental conditions. In particular, polystyrene hardness ($Kg/m^3$), polystyrene production processes, its aging and its purity are features that make each piece different from one another. In that sense, it is not possible to standardize overall speed and temperature values for all types of pieces, as each piece can have a hardness and/or impurities that requires modifications of such parameters. In addition, also environmental parameters such as surrounding temperature and humidity level can vary time after time the behavior of the piece to be processed.

Precisely because of this problem, the method requires the setting of a certain standard temperature and of the machinery with a speed, known as statistically optimal for that type of processed block. Obviously, as mentioned, such process is very rudimentary and leads to approximate results. Moreover, the inaccuracy of the set parameters arises during cutting, thus leading inevitably to a qualitative waste of the product and compelling the operator to select another block, hoping that, as a consequence, parameters will be better set than before.

The foregoing deficiencies in prior art processes cause a high amount of waste and a huge waste of working time.

SUMMARY OF THE INVENTION

It is therefore the aim of the present invention to provide a device for cutting polystyrene which solves said technical inconveniences.

In particular, it is the aim of the present invention to provide a device that cuts polystyrene blocks precisely, according to preset geometries, thus minimizing waste and the required time.

These and other aims are therefore obtained through the present device for cutting a polystyrene block (100) by advancing a hot wire to a predetermined speed (V), as disclosed herein.

Such device (20, 200) comprises means (M, S; 250, 230) configured for detecting an inclination of the wire during cutting such that a potential inclination deviation in respect to a reference inclination can be detected and advancement speed (V) may be varied depending on the said detected deviation of inclination.

In this way, simply detecting the wire inclination, it is possible to evaluate conveniently how to vary the speed so as to bring back the wire to the rectilinear condition wherein the cut is correct.

In a possible embodiment, advantageously, such means comprise at least a one lever element (21; 210) to which at least a one hot cutting element (2) can be applied.

The lever element is preferably assembled on suitable motorized supports, moving it according to a predetermined cutting direction.

According to the invention, the lever element (21; 210) is arranged in such a manner that it can follows, in use, a possible inclination assumed by the cutting element (2), during the advancement motion of the cut.

The wire inclination, that is, its bending, shows an advancement speed condition that is too high.

Therefore, it is enough to detect said inclination to correct the speed, thus reducing it conveniently.

For that purpose, the lever element (21; 210) is further cooperative with a sensor (M, S; 250, 230), which can detect one or more parameters indicating or attributable to an inclination acquired by of the lever element (21; 210) during the cut.

In this way, it is enough to have a controlling device (CL) (for example, even a preexisting one of a previous machinery) and to program it in such a manner so as to detect a potential deviation of inclination in respect to a reference inclination and, consequently modulate the advancing speed (V) of the lever element depending on said detected deviation of inclination.

In this way, it is possible to work precisely by maintaining a permanent temperature and acting on the speed only depending on the "local" condition of the cut.

Advantageously, said controlling device (CL) may be connected to the sensor and programmed for processing the parameter/s detected by the sensor, indicating the inclination of assumed by the lever element and modulating said speed consequently.

Advantageously, the speed is modulated in such a manner that the lever element (21; 210) is brought back to said reference condition.

For this purpose, advantageously, the controlling device is programmed so as to reduce the speed until it eliminates such detected deviation.

Advantageously, the controlling device is programmed to vary the speed cyclically by increasing it, once such nullifying condition of the deviation has been reached, and by reducing it again when it detects a deviation.

In this way, the cutting is accelerated and, contemporaneously, the condition wherein the wire advancement is too slow in respect to the preset temperature is avoided, as this condition creates an excessive local melting.

Advantageously, said lever element (21, 210) is constrained to a support in such a manner so as to take at least a one direction of inclination in respect to the constraint point (C; 220).

In particular, advantageously, said lever element is hinged.

Advantageously, said sensor is a HALL sensor.

As an alternative, advantageously, said sensor is an infrared sensor or an ultrasonic one.

Advantageously, such device can be integrated into a pre-existent machinery for cutting polystyrene.

Therefore, the device can be integrated into pre-existent machineries provided with their own controlling device which can be programmed as required.

As an alternative, an assembly can be provided, with its own controlling device, to be installed always on pre-existent machineries, or a machine built with such assembly can be provided.

For that purpose, an assembly may be provided for cutting a polystyrene block (100) by the advancement of a hot wire at a predetermined speed (V) and may comprise means (CL, M, S; 250, 230) configured for detecting an inclination of the wire during the cut and a controlling device (CL)

The controlling device checks a potential inclination deviation in respect to the reference inclination and modulates the advancement speed (V) depending on said detected deviation of inclination.

Advantageously, at least a one lever element (21, 210) may be provided, to which at least one hot cutting element (2) can be applied and with the controlling device (CL) communicating with said device (20, 200). The lever element (21, 210) is arranged in such a manner that it can follow in use a possible inclination assumed by the cutting element (2), during the advancement motion of the cut, said lever element (21; 210) being further cooperative with a sensor (M, S; 250, 230) indicating an inclination assumed by the lever element (21; 210) while cutting, the controlling device (CL) being configured to check said potential deviation of inclination in respect to a reference inclination and to modulate consequently the advancement speed (V) of the lever element depending on said detected deviation of inclination.

Advantageously, the controlling device is programmed to modulate the speed in such a manner so as to bring back the lever element (21; 210) to said reference condition.

Advantageously, such lever element is hinged.

Advantageously, said sensor is a HALL sensor, or, as an alternative, it can be an infrared sensor or an ultrasonic one.

Advantageously, the controlling device is programmed in such a manner so as to reduce the speed until it eliminates such detected deviation.

Advantageously, the controlling device is programmed in such a manner so as to vary the speed cyclically by increasing it, once such eliminating condition of the deviation has been reached, and by reducing it again when it detects a deviation.

Machinery is also disclosed for cutting polystyrene that comprises an assembly as described or a device as described.

A method is also disclosed for cutting a polystyrene block (100), the method providing the arrangement of a device (20, 200) having at least a one lever element (21; 210) to which at least one hot cutting element (2) can be applied, and the arrangement of a controlling device (CL), said lever element (21; 210) being arranged so that a possible inclination assumed by the cutting element (2) can be tracked in use, during the advancement motion of the cut, such lever element (21; 210) being further cooperative with a sensor (M, S; 250, 230) indicating a potential inclination assumed by the lever element (21; 210) while cutting, the method providing the detection of the inclination of the lever element (21, 210) and the check by the controlling device (CL) of a potential variation of the inclination over an initial reference inclination and the consequent modulation of the advancement speed (V) of the lever element depending on said detected variation of inclination.

Advantageously, the speed is modulated in such a manner to bring back the support to said initial reference condition.

Advantageously, the speed is modulated to vary the speed cyclically by increasing it, once such eliminating condition of the deviation has been reached, and by reducing it again when the deviation is detected.

BRIEF DESCRIPTION OF THE DRAWINGS

Further features and advantages of the present invention will be clearer with the description that follows of some embodiments, made to illustrate but not to limit, with reference to the attached drawings, wherein.

DESCRIPTION OF SOME PREFERRED EMBODIMENTS

Figure 1:
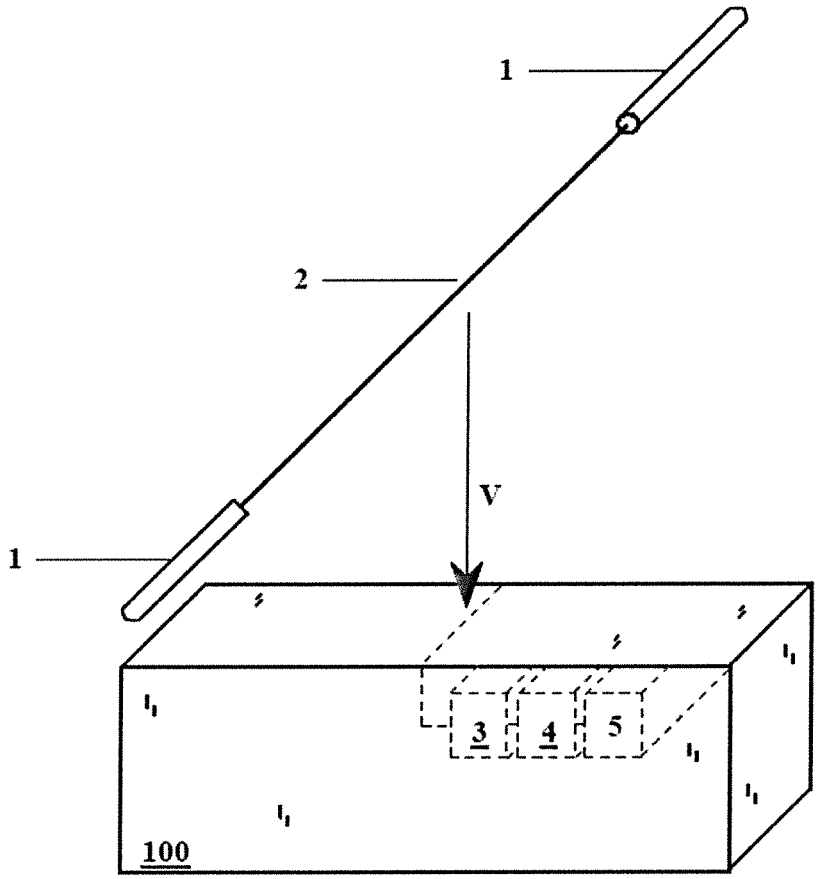
FIG. 1 shows in axonometric view an outline of a polystyrene block 100 which has to be cut according to a predetermined geometry with a hot wire 2.

With reference to FIG. 1, a wire 2 is represented schematically for cutting polystyrene and it is linked at its ends to two sliders 1. The figure represents schematically a block 100 which, as example, is cut by the wire 2 in such a manner so as to obtain a series of elongated pieces with square section (3, 4, 5).

Therefore, the wire follows a cutting path represented by the dashed line and which comprises a vertical section, a second horizontal section and then the production of elongated pieces placed side by side with a sequence of horizontal and vertical motions.

Obviously, this cutting pattern is only an example of many possible cutting patterns, as, depending on geometries, the motion of the wire 2 can also have different directions, such as diagonal and/or curved.

Figure 2:
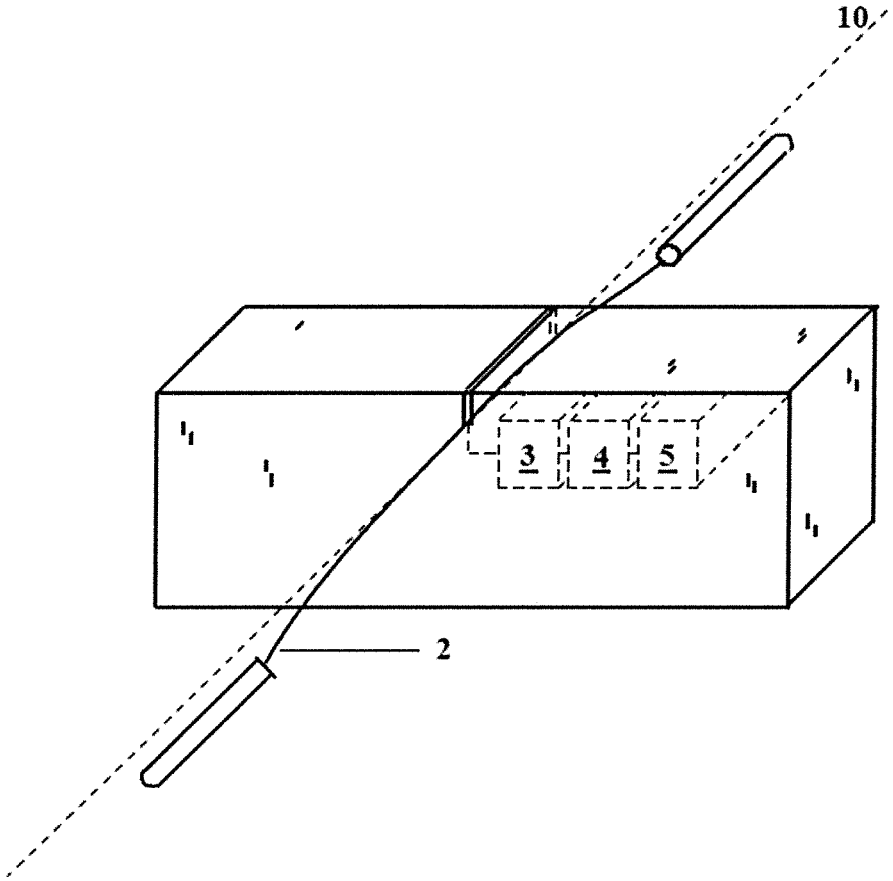
FIG. 2 shows a hypothetical cutting step wherein the wire 2 bends in respect to the perfect linearity direction 10 of the wire. Any cutting direction can obviously be used, even diagonal.

As shown schematically in FIG. 2, the advancement motion speed may be too high during the cut, due to the kind of block to be cut, thus leading to wire bending. In fact, FIG. 2 shows schematically an ideal and perfectly rectilinear direction 10 of wire compared to the real curved trend (that is, the bending) of assumed by the wire during the cutting in this particular case.

In order to solve said technical inconvenience, a solution is proposed providing for the use of a sensor device (20, CL) configured to detect an alignment deviation of the wire (that is, an inflected wire) in respect to a reference condition represented by the linearity condition of the wire (that is, a non-curved wire).

Substantially, the system detects a bending deviation of the wire in respect to a reference linear condition.

At this point, a correlation between the advancement motion speed of the wire and its detected alignment deviation is created so as that a speed variation is generated depending on such deviation.

More particularly, as soon as a wire bending is detected, a speed reduction takes place, thus annulling such bending and, therefore, the wire is brought back to an aligned condition, which is the initial reference condition. Obviously, as explained below, such speed modulation is not accidental but is a function of the detected bending.

Figure 3:
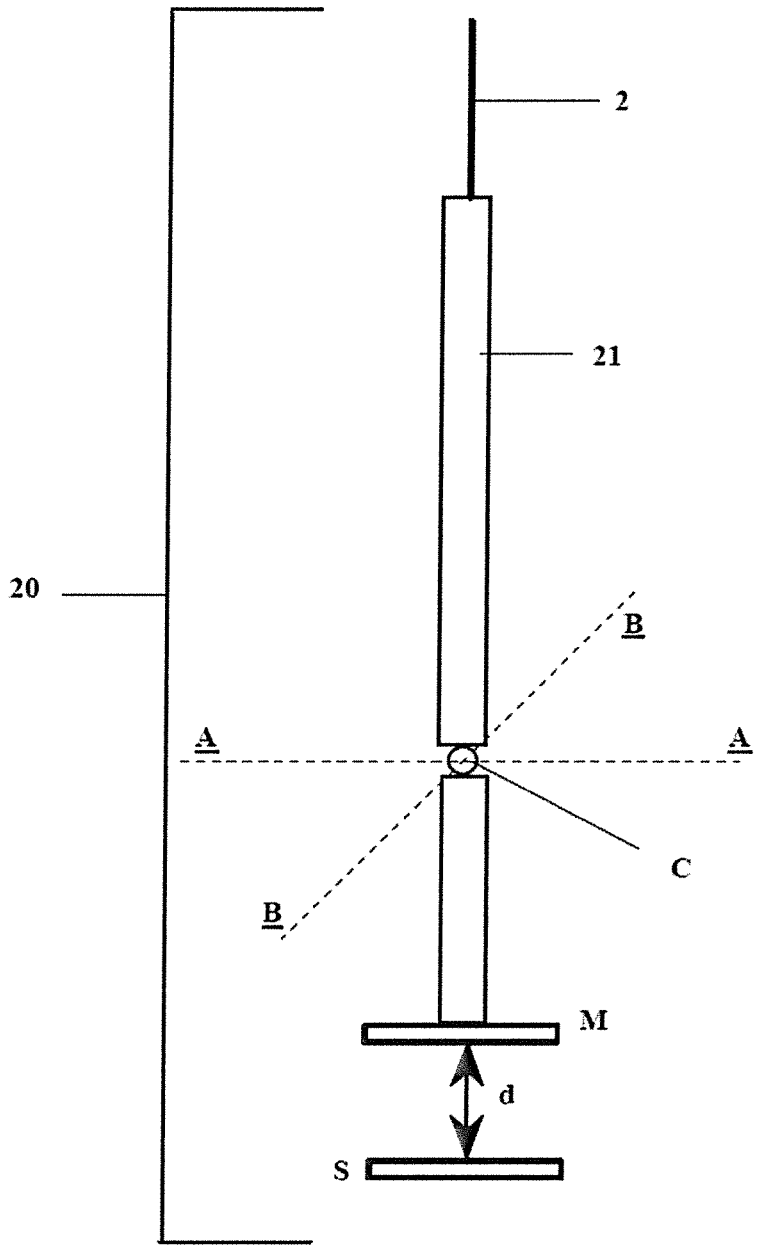
FIGS. 3 and 4 represent schematically a solution with the use of a HALL sensor.

FIG. 3 outlines such kind of solution structurally, by outlining as a whole the device 20 comprising a sensor.

The below described device 20 may be an element which can be mounted on pre-existing cutting machineries (that is, equipped with an advancement motion engine, controlling devices, etc.) or a cutting machine can be built including such integrated device.

As outlined in FIG. 3, a lever element 21 is provided, to which a wire 2 can be connected for the cutting.

The lever element is equipped with a sensor (M, S).

A HALL sensor can be particularly suitable for these purposes, as it is particularly precise and sensitive.

The sensor can be of the two-axis type (A-A; B-B) or three or more axis depending on need.

The following internet address gives an example of a description of a usable HALL sensor; it is produced by the factory MELEXIS and the sensor is commercially named "Triaxis".

mlxsemi.com/Position--Speed-Sensors/Triaxis®-Hall-ICs/Triaxis-760.aspx

Figure 4:
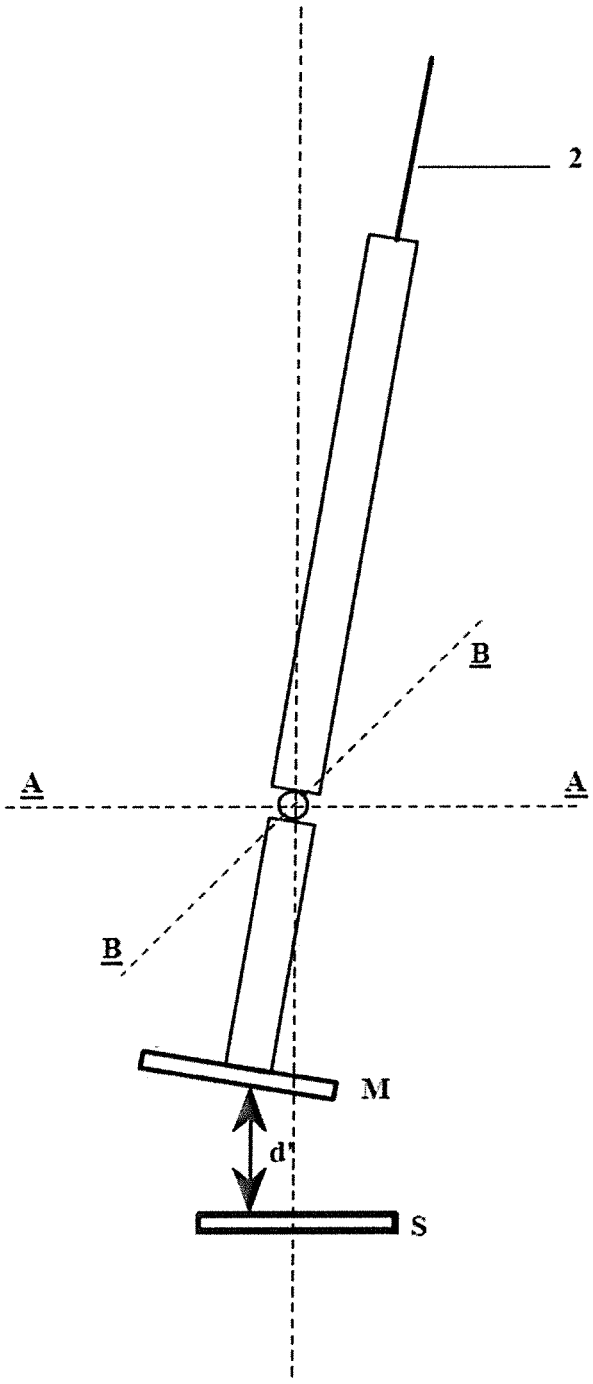

This kind of sensor, as outlined in FIGS. 3 and 4, includes a magnet M, which generates a magnetic field, and an element S sensitive to such magnetic field. Such element S is able to detect a variation of the magnetic field when and whether the magnet modifies its position.

Therefore, the lever element 21 is hinged to a point (C) on a rigid support, which provides a support structure (obviously, the whole element is transportable and mountable on pre-existing machineries).

FIG. 3 shows the two axis A-A and B-B around where, for example, such lever 21 can rotate even if, obviously, the axis may be different both in number and in direction.

The HALL sensor is provided to the opposite side of the hinging, at the opposite side to the application point of wire 2. Therefore, the figure shows the magnet M and the sensor S below, detecting the magnetic field and its variations.

As per FIG. 3, during the cut, when the wire keeps a rectilinear direction in axis with the lever 21, then the magnet keeps a certain distance (d) in respect to the sensor S and the sensor detects a certain value of the magnetic field, which is considered as the reference value.

As per FIG. 4, as the wire bends, then the lever follows the wire inclination, due to hinging, thus modifying the distance between the magnet M and the sensor S, so that the sensor detects such magnetic field variation in respect to the reference condition.

It is therefore possible, through the controlling device (CL), to process the measures detected by the sensor, in order to check if there is a deviation over the reference condition and to modulate the advancement speed depending on such inclination deviation in respect to an initial reference condition (therefore, to modulate the speed depending on a magnetic field variation detected by the element S in function of a magnetic field condition, considered as initial reference).

Therefore, as the wire moves forward too quickly in respect to the set temperature and/or in respect to the type of block to be cut and/or the environmental conditions, then the wire bends and such angle variation, over the rectilinear condition, is immediately detected by the element S in terms of magnetic field variation over the reference condition, as the lever 21 indeed is inclined, thus dragging the magnet M.

A preset quantification of such field variation, detected by the sensor, can be easily linked to a certain percentage of necessary speed reduction.

The mathematical law which links a field variation, detected by the sensor S, to the necessary speed reduction can be, for example, of linear type such that a line of progressive deceleration can be easily created as a function of an increase in magnetic field deviation. Substantially, a certain deceleration can be associated to each of the detected magnetic field change delta.

Figure 5:
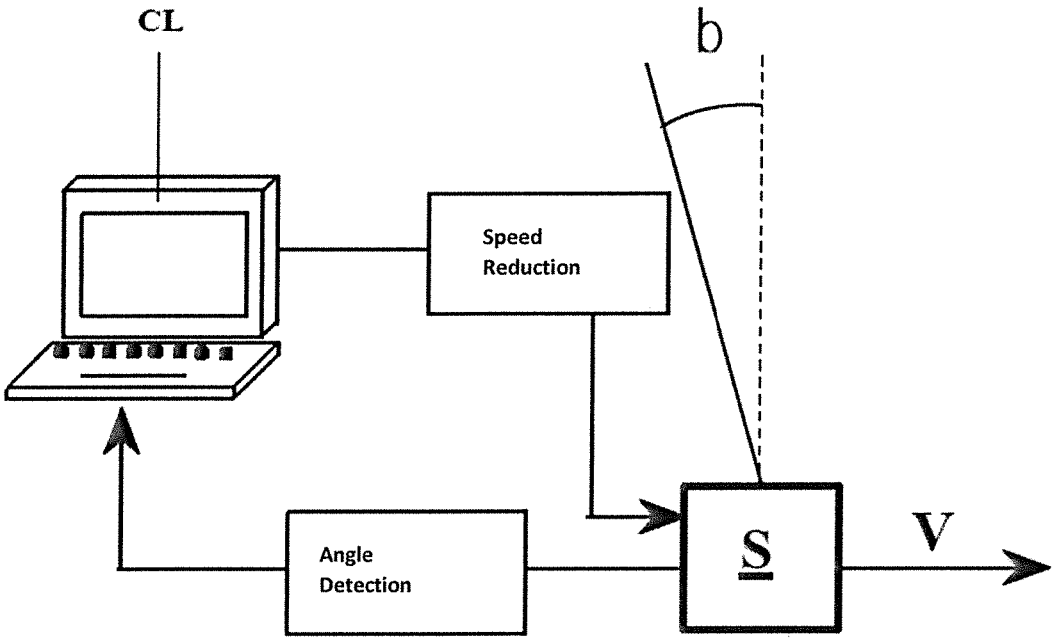
FIG. 5 illustrates schematically the operation.

Therefore, as schematically shown in FIG. 5, the assembly which provides for a slider provided with the sensor connected to it, is linked to the controlling device (CL), such as a PLC or also programmable PC computers.

Minute by minute, during the cutting phase, the element S measures the detected field and sends the detected survey to the controlling device (CN). The controlling device checks if there is a field deviation in respect to the set reference value and orders a consequent speed reduction if it finds a deviation (reduction connected to the set mathematical law depending on the detected deviation value). Therefore, such speed reduction can be proportional to the detected deviation, so as to tend to progressively bring the wire in a condition of linearity, gradually, while the speed is reduced.

Figure 6:
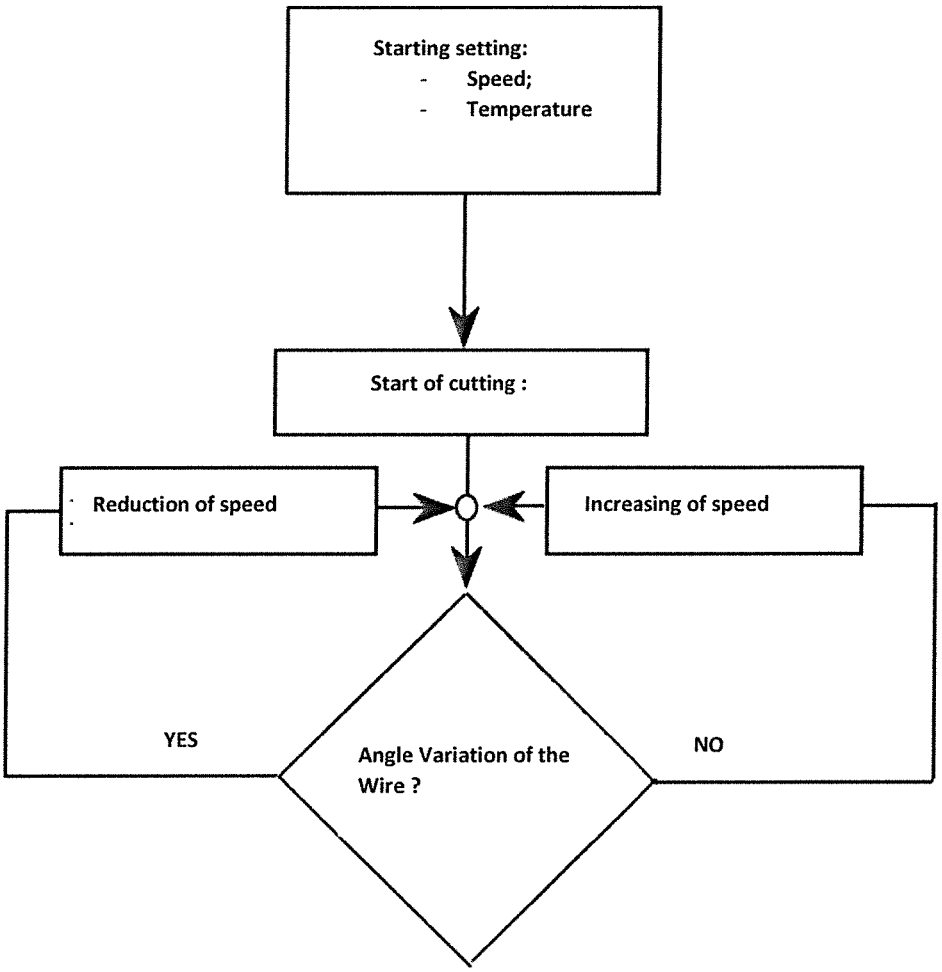
FIG. 6 is an overall flowchart of operation.

More particularly, the flowchart of FIG. 6 better explains the cutting operation.

The cutting temperature is kept steady in a traditional way and is not varied, and is generally set to a value immediately below the melting or breaking value of the wire in use, so as to take advantage of the maximum advancement speed.

In case of a too slow advancement motion in respect to the piece to be cut and to the set temperature, the wire does not bend and remains perfectly aligned but an excessive combustion takes place locally and this event cannot be detected, as the sensor does not detect any angle variation of the wire.

To avoid this inconvenience, the cutting method provides also for a setting of an extremely high initial speed for any kind of polystyrene piece to be cut. For example, the speed may be 2,200 mm per minute, considering that, on average, the cutting speed is approximately 600 or 700 mm per minute, or even less.

Substantially, the initial condition provides for the maximum tolerable temperature for the hot wire and the maximum achievable speed.

As soon as the cutting begins, the wire moves towards the block, and bends as soon as it meets the piece, due to the initial high speed. The sensor, within the necessary responsiveness time, immediately detects a high field variation and the controlling device, once verified the field deviation in respect to the reference field value which represents the linearity condition of the wire, processes such difference in respect to the initial reference condition and orders a drastic speed reduction, which causes the slider nearly to stop.

Anyway, the wire bending and its temperature are sufficient (due to the elastic returns of the wire) to keep cutting because of inertia, until the wire is in a perfectly linear condition, with a consequent return of the field value within the set reference value.

Figure 7:
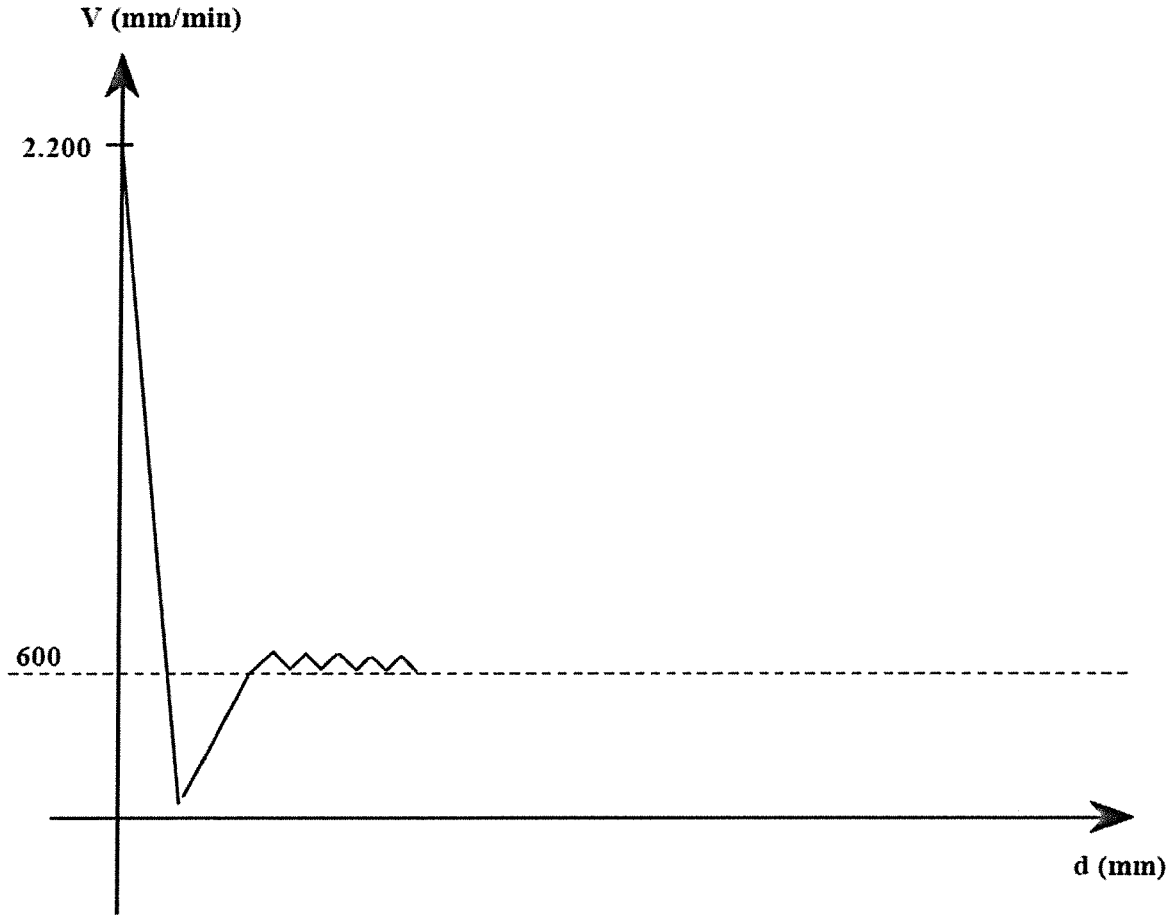
FIG. 7 shows a trend of the cutting speed according to the present method.

The flowchart of FIG. 7 shows, with the first descending part, the initial cutting phase, where a sudden speed reduction almost to zero takes place until the wire is in a linear condition.

The system is programmed in such a manner that each linearity condition of the wire is followed by a progressive speed increase. This is for guaranteeing not only the maximum efficiency, but also and specially to prevent the wire from cutting too slowly in respect to the set temperature.

In this sense, therefore, the slider starts to move with a progressively increasing speed, until it reaches its ideal equilibrium condition represented by the horizontal line set to the 600 mm/min value, as an example.

At this point, in the preferred cutting way, such speed is not kept unvaried (even if it is practicable) but it is preferable to continue varying such speed minute by minute. In particular, at the moment when the condition of an aligned wire is reached (600 mm/min in the example of FIG. 7), the controlling device continues to order a progressive acceleration, therefore a speed increase, until a slight axis variation of the wire is caused with a consequent new speed reduction for bringing back the wire in axis. The entire process takes place uninterruptedly during the cutting minute by minute. The result is that, as a whole, on average, the optimal speed appears to be kept unvaried, but, actually, such slight variations create oscillations around an equilibrium speed and make the system adapt best to the "local" cutting condition which is in operation, thus avoiding the risk of a "locally" low cutting speed in a specific point with a consequent cutting defect.

Therefore, in this way, by maintaining the temperature unvaried and starting from a high initial cutting speed, the system automatically adapts the cutting speed minute by minute, depending on the local conditions of the area to be cut.

In this particularly simply manner, a precise cut is achieved, thus correcting well the imperfections due to environmental causes and typical features of polystyrene.

In a variation, by starting from a high cutting speed as already mentioned, nothing could prevent the wire from keeping the reached speed unvaried during the cutting operation, possibly reducing it when an angle variation is detected, even if, in this case, the inconvenience of not preventing an excessive temperature of the wire can take place in the specific cutting point (such a condition can vary locally within the same block to be cut, as already mentioned).

Considering what has been described above, obviously, other types of sensors able to detect an inclination variation of the wire during the cutting may be used anyway.

For example, infrared sensors, ultrasound sensors or laser sensor may be used.

Figure 8:
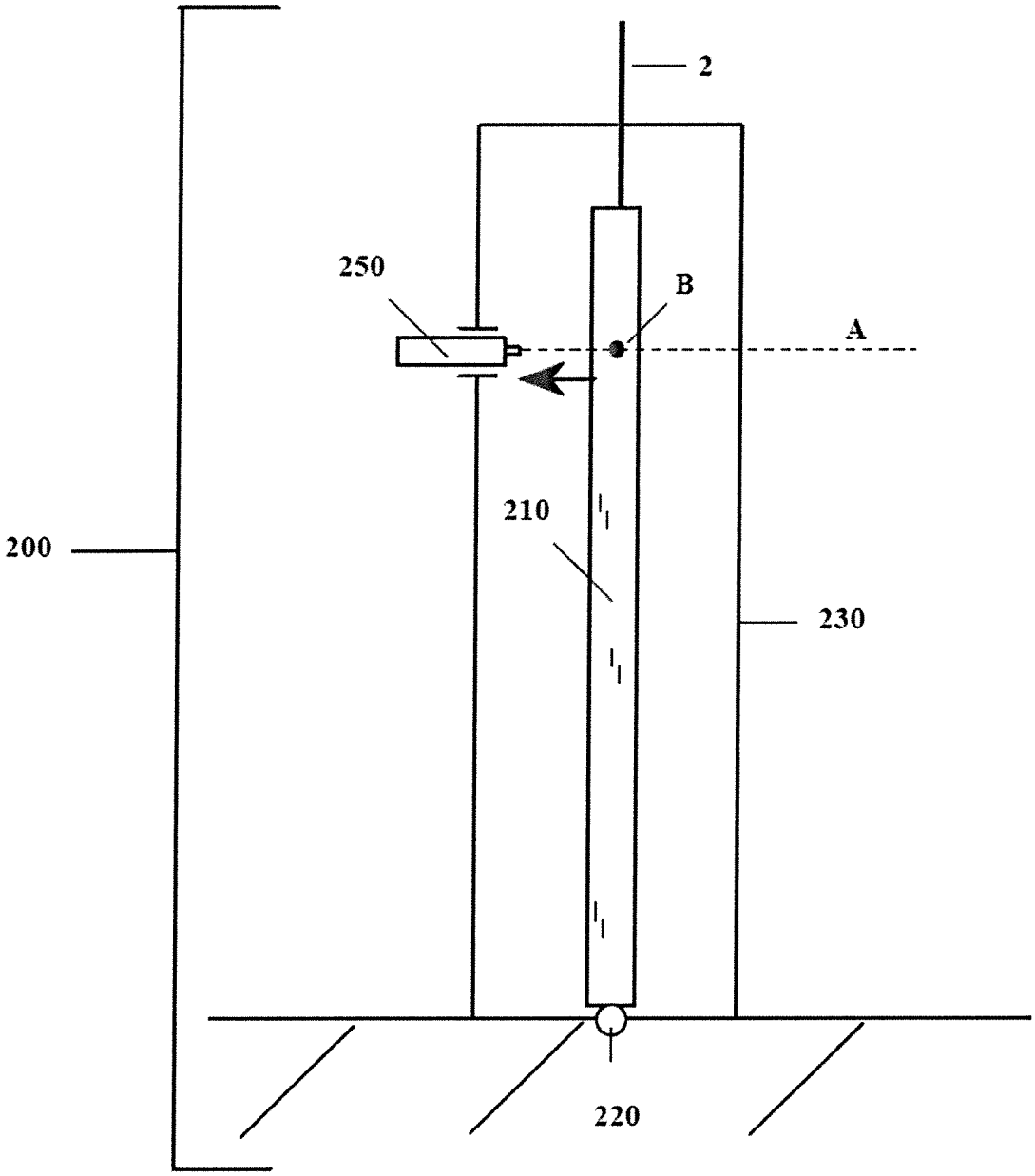
FIG. 8 shows schematically a type of alternative sensor which can be used in place of the HALL sensor.

An example is shown in FIG. 8.

Such figure shows an example of a solution 200 with an ultrasound sensor or a laser one.

In this case, the lever element 210 is hinged at one of its ends (through a hinge 220) within a tubular duct 230, prearranged fixed in a support.

The external tubular comprises two holes in axis at 90 angles, in which there are respectively arranged two ultrasonic emitters 250 that project on two orthogonal axes (A-B). The axis B is shown as exiting from the drawing surface.

Ultrasounds intercept the lever element 210 and are reflected backwards. The return period allows to calculate the position of the lever element is in axis or not. In particular, exactly as in the previous case, the processor processes returning data and checks if there is a position in axis or a misalignment in respect to the reference condition.

Therefore, in this way, any misalignment is easily detectable, approaching/distancing the lever element from the respective emitters and therefore, a deviation can be detected from a reference condition which represents the lever element in axis.

In function of the detected deviation, the controlling device reduces speed proportionally.

As already mentioned above, in all embodiments, such device can be separated from any machinery and thus assembled also on pre-existing machineries.

The device connects then to the controlling device (for example the PC), which is programmed for receiving from the sensor the detected data and regulating consequently the advancement speed.

Obviously, machineries with such an integrated system can be provided.

Considering what has been described above, a further embodiment may provide for a detection of the wire inclination during the cutting, for example through a camera system or through a laser sensor which detects the wire, therefore, without necessarily taking advantage of the system of lever inclination following the wire but instead by prearranging it unmovably. This solution, even achievable, is more constructively complex and, therefore, may be less precise.

The invention claimed is:

1. A device (20, 200) for cutting a polystyrene block (100), comprising:

a cutting element, the device causing the cutting element to move at an initial advancement speed;

one or more sensors (M, S; 250, 230) configured to detect a bending of the cutting element during the cutting so that a bending variation of the cutting element can be verified in respect to a reference condition;

a controlling device (CL) causing the device to modulate the advancement speed (V) of the cutting element depending on the detected bending variation; and a lever (21; 210) operatively coupled to the cutting element and arranged to follow, in use, the bending of the cutting element during an advancement motion thereof, the lever (21; 210) further cooperating with the one or more sensors (M, S; 250, 230), which detect the bending of the cutting element by detecting an inclination variation of the lever (21; 210) caused by the bending of the cutting element, so that the controlling device (CL) can check the bending variation in respect to the reference condition and, consequently, modulate the advancement speed (V) of the cutting element depending on the bending variation.

2. The device, as per claim 1, wherein said controlling device (CL) is connected to the one or more sensors and programmed for calculating one or more parameters detected by the one or more sensors indicating the inclination variation of the lever during the cutting and modulating said advancement speed consequently.

3. The device, as per claim 1, wherein the advancement speed is modulated in such a manner that the lever (21; 210) is brought back to said reference condition.

4. The device, as per claim 1, wherein said lever (21, 210) is constrained to a support so as to take at least one direction of inclination in respect to a constraint point (C; 220).

5. The device, as per claim 1, wherein said lever is hinged.

6. The device, as per claim 1, wherein at least one of said one or more sensors is a HALL sensor.

7. The device, as per claim 1, wherein at least one of said one or more sensors is an infrared sensor or an ultrasonic sensor.

8. The device, as per claim 1, wherein the controlling device is programmed to reduce then advancement speed until said detected inclination variation is nullified.

9. The device, as per claim 1, wherein the controlling device is programmed to vary then advancement speed cyclically by increasing the advancement speed as soon as the inclination variation has been nullified, and by reducing the advancement speed again when the controlling device detects a deviation in the inclination variation that exceeds a preset limit.

10. The device, as per claim 1, wherein the device is adapted to be integrated on a pre-existent machinery for cutting polystyrene.

11. An assembly for cutting a polystyrene block (100) by an advancement of a hot wire at a predetermined speed (V), comprising:

one or more sensors (CL, M, S; 250, 230) that detect an inclination of the hot wire during a cut; and a controlling device (CL) adapted to check a bending variation in respect to a reference condition, the controlling device causing the assembly to modulate advancement speed (V) of the hot wire depending on a detected bending variation;

a lever (21, 210) (21; 210) adapted to be operatively coupled to the hot wire, said lever being arranged to follow, in use, the inclination of the hot wire during the advancement thereof, said lever (21; 210) further cooperating with the one or more sensors (M, S; 250, 230), which detect the inclination of the hot wire by detecting an inclination variation of the lever (21; 210) during the cutting of the polystyrene block (100) by the hot wire, wherein the controlling device (CL) is configured to check said the inclination variation of the lever (21; 210) in respect to a reference inclination.

12. The assembly, as per claim 11, wherein the controlling device (CL) is programmed to vary the advancement speed so as to lead back the lever (21; 210) to said reference inclination.

13. The assembly, as per claim 11, wherein said lever (21, 210) is constrained to a support so as to take at least a direction of inclination in respect to a constraint point (C; 220).

14. The assembly, as per claim 11, wherein said lever is hinged.

15. The assembly, as per claim 11, wherein the controlling device is programmed to reduce then advancement speed until the controlling device nullifies the detected bending variation.

16. The assembly, as per claim 15, wherein the controlling device is programmed to vary then advancement speed cyclically by increasing the advancement speed as soon as the bending variation has been nullified, and by reducing the advancement speed again when the controlling device detects the bending variation.

17. A machinery for cutting polystyrene comprising:

an assembly adapted to cut a polystyrene block by a motion of a hot wire cutter at a predetermined speed configured according to claim 11.

18. A method of cutting of a polystyrene block (100), the method comprising:

providing a device (20, 200) having at least one lever (21; 210) that is operatively coupled to at least a-one hot cutting element (2);

providing one or more sensors adapted to detect an inclination of the at least one lever;

providing a controlling device (CL);

causing said controlling device to detect a bending of the hot cutting element (2), during the cutting by receiving information from the one or more sensors on the inclination of the one or more levers and by checking, with the controlling device, a deviation of the inclination from a reference condition; and modulating an advancement speed (V) of the at least one hot cutting element depending on a detected deviation.

19. The method, as per claim 18, wherein the advancement speed is modulated so as to bring back the at least one hot cutting element to an initial reference condition.

20. The method, as per claim 18, wherein the advancement speed is modulated so as to vary the advancement speed cyclically by increasing the advancement speed, once a nullifying condition of the deviation has been reached, and by reducing the advancement speed again when the deviation is detected.

* * * * *